US005421165A

United States Patent [19]

Paradowski et al.

[11] Patent Number: 5,421,165

[45] Date of Patent: Jun. 6, 1995

[54] PROCESS FOR DENITROGENATION OF A FEEDSTOCK OF A LIQUEFIED MIXTURE OF HYDROCARBONS CONSISTING CHIEFLY OF METHANE AND CONTAINING AT LEAST 2 MOL % OF NITROGEN

[75] Inventors: Henri Paradowski, Cergy; Christine Mangin, Courbevoie; Claude Blanc, Pau, all of France

[73] Assignee: Elf Aquitaine Production, Paris, France

[21] Appl. No.: 81,326

[22] PCT Filed: Oct. 22, 1992

[86] PCT No.: PCT/FR92/00991

§ 371 Date: Aug. 11, 1993

§ 102(e) Date: Aug. 11, 1993

[87] PCT Pub. No.: WO93/08436

PCT Pub. Date: Apr. 29, 1993

[30] Foreign Application Priority Data

Oct. 23, 1991 [FR] France ..... 91 13081

[51] Int. Cl.[6] ..... F25J 3/02

[52] U.S. Cl. ..... 62/24; 62/38; 62/39; 585/800

[58] Field of Search ..... 62/24, 39, 38; 585/800

[56] References Cited

U.S. PATENT DOCUMENTS

| | | | |
|---|---|---|---|
| 4,455,158 | 6/1984 | Vines et al. | 62/39 |
| 4,718,927 | 1/1988 | Bauer et al. | 62/24 |
| 5,051,120 | 9/1991 | Pahade et al. | 62/24 |

FOREIGN PATENT DOCUMENTS 3822175 1/1990 Germany .

*Primary Examiner*—Ronald C. Capossela
*Attorney, Agent, or Firm*—Burgess, Ryan & Wayne

[57] ABSTRACT

The invention is a process for the denitrogization of a liquefied natural gas (LNG) comprising methane and at least 2 Mols. of nitrogen. The process is distinguished in that the LNG is introduced into the process as a liquid and is subject to an indirect heat exchange to cool the liquid and a further decompression before introduction into fractionation of column. A portion of the liquid flowing in the fractionation column is withdrawn and utilized to cool the LNG feedstock and is returned to the fractionation column at a level lower than the level from which it was withdrawn. The decompression of LNG feedstock comprises at least one dynamic decompression and at least one static decompression.

13 Claims, 4 Drawing Sheets

PROCESS FOR DENITROGENATION OF A FEEDSTOCK OF A LIQUEFIED MIXTURE OF HYDROCARBONS CONSISTING CHIEFLY OF METHANE AND CONTAINING AT LEAST 2 MOL % OF NITROGEN

BACKGROUND OF THE INVENTION

1. Field of the Invention

The invention relates to a process for denitrogenation of a feedstock of a liquefied mixture of hydrocarbons, referred to by the abbreviation LNG, consisting chiefly of methane and also containing at least 2 mol % of nitrogen, in order to lower this nitrogen content to less than 1 mol %.

The gases which are supplied under the name of natural gases for the purpose of being used as fuel gases or as components of fuel gases are mixtures of hydrocarbons consisting chiefly of methane and generally containing nitrogen in a variable quantity which can reach 10 mol % or more.

It is commonplace to liquefy the natural gases on the site where they are obtained to produce liquefied natural gases (LNG), this liquefaction making it possible to reduce approximately six hundred times the volume occupied by a given molar quantity of gaseous hydrocarbon mixture, and to transport these liquefied gases towards the places where they are used by performing this transportation in large-sized thermally insulated storage vessels which are at a pressure equal to or slightly higher than atmospheric pressure. At the places where they are used, the liquefied gases are either vaporised for an immediate use as fuel gases or as components of fuel gases or else are stored in storage vessels of the same type as the transport storage vessels with a view to a subsequent use.

The presence of nitrogen in a significant quantity, for example greater than 1 mol %, in liquefied natural gas is detrimental because it increases the cost of transport of the given quantity of hydrocarbons and, moreover, it also reduces the calorific value of the fuel gas produced by vaporising a given volume of liquefied natural gas, and it is common practice to subject the liquefied natural gas before it is transported or before it is vaporised to a denitrogenation with a view to lowering its nitrogen content to an acceptable value, generally lower than 1 mol % and preferably lower than 0.5 mol %.

2. Related Art

The article by J-P. G. Jacks and J. C. McMillan entitled "Economic removal of nitrogen from LNG" and published in the journal Hydrocarbon Processing, December 1977, pages 133 to 136, describes, among other things, a process for denitrogenation of liquefied natural gas by stripping with reboiling in a denitrogenation column. In such a process (cf. FIG. 3) an LNG feedstock at a pressure above atmospheric pressure is subjected to cooling by indirect heat exchange and then decompression to a pressure close to atmospheric pressure, the cooled LNG feedstock is introduced into a denitrogenation column comprising a plurality of theoretical fractionation stages, an LNG fraction is withdrawn at the bottom of the denitrogenation column and the said fraction is employed to carry out the indirect heat exchange with the LNG feedstock to be treated, then, after the said heat exchange, this fraction is reinjected into the denitrogenation column as a reboiling fraction, this injection being carried out below the last bottom tray of the denitrogenation column, a gaseous fraction rich in methane and nitrogen is removed at the top of the denitrogenation column and a denitrogenated LNG stream is drawn off at the bottom of the said column. The gaseous fraction rich in methane and nitrogen collected at the top of the denitrogenation column is compressed after recovery of the negative calories which it contains to form a fuel gas stream which is employed on the site which includes the denitrogenation plant.

A major disadvantage of the denitrogenation process such as that cited above lies in the fact that the quantity of fuel gas obtained from the gaseous fraction rich in methane and nitrogen which is collected at the top of the denitrogenation column is much greater than the site requirements, generally a natural gas liquefaction site, on which the denitrogenation unit is present. If the denitrogenation is conducted so as to make the methane content of the fuel gas produced correspond to the requirements of the plant, the gaseous fraction removed at the top of the denitrogenation column, and consequently the fuel gas corresponding to it, contain a large quantity of nitrogen, which can be greater than 50 mol % in some cases. In order to burn such a fuel gas it is necessary to resort to a burner technology adapted to fuel gases of low calorific value, and this results in technological problems when it becomes necessary to replace the said fuel gas with a natural gas of high calorific value.

German Patent Application No. 3,822,175, published on 4.1.90, relates to a process for denitrogenation of natural gas, in-which the natural gas at elevated pressure is cooled, after separation of the high boiling point compounds which it contains, by indirect heat exchange, and then decompressed to a pressure of a few bars to produce a liquid natural gas phase which is introduced into a denitrogenation column operating at a pressure of a few bars, the said column producing, at the top, a nitrogen-rich gaseous fraction and, at the bottom, a denitrogenated LNG stream. In this process a first and a second liquid fraction are withdrawn from the denitrogenation column at levels of this column which are situated between its middle part and its lower part and below the level of introduction of the liquid natural gas phase, and these fractions are employed to carry out the indirect heat exchange resulting in the cooling of the natural gas, and then the said fractions are reinjected into the denitrogenation column after the said heat exchange. The reinjection of each fraction is performed at a level of the denitrogenation column which is situated below the level of withdrawal of this fraction and so that the level of reinjection of the topmost withdrawal fraction is situated between the levels of withdrawal of the two fractions.

SUMMARY OF THE INVENTION

The subject invention is an improved process for denitrogenation of an LNG employing a denitrogenation column with reboiling, which makes it possible easily to lower the nitrogen content of the LNG to less than 1 mol % and more particularly to less than 0.5 mol %, while limiting the quantity of fuel gas which is produced and the nitrogen content of this fuel gas.

The process according to the invention for the denitrogenation of a feedstock of a liquefied mixture of hydrocarbons (LNG) consisting chiefly of methane and containing at least 2 mol % of nitrogen, in order to lower this nitrogen content to less than 1 mol %, is of the type in which the LNG feedstock to be treated, delivered at a pressure above 0.5 MPa, is subjected to cooling by indirect heat exchange and decompression to a pressure of between 0.1 MPa and 0.3 MPa, the refrigerated LNG feedstock is introduced into a denitrogenation column comprising a plurality of theoretical fractionation stages, at least one first LNG fraction is withdrawn from the denitrogenation column at a level situated below the level of introduction of the refrigerated LNG feedstock and the said first fraction is employed to carry out the indirect heat exchange with the LNG feedstock to be treated, then, after the said heat exchange, this first fraction is reinjected into the denitrogenation column as a first reboiling fraction, this injection being carried out at a level situated below the level of withdrawal of the said first fraction, a gaseous fraction rich in methane and nitrogen is removed at the top of the denitrogenation column and a denitrogenated LNG stream is drawn off at the bottom of the said column, and it is characterised in that the decompression of the LNG feedstock to be treated comprises a primary decompression carried out dynamically in a turbine upstream or downstream, preferably upstream, of the indirect heat exchange between the LNG feedstock and the LNG fraction(s) withdrawn from the denitrogenation column, and a secondary decompression performed statically after the said indirect heat exchange and the dynamic decompression.

The dynamic primary decompression of the LNG feedstock is advantageously carried out down to a pressure such that there is no vaporisation of LNG in the decompression turbine.

According to the invention, a second LNG fraction is preferably also withdrawn from the denitrogenation column at a level of this column which is situated between the level of introduction of the cooled LNG feedstock and the level of withdrawal of the first LNG fraction, this second LNG fraction is conveyed to an indirect heat exchange with the LNG feedstock which has already undergone the indirect heat exchange with the first LNG fraction and, after the heat exchange, this second LNG fraction is reinjected into the denitrogenation column as a second reboiling fraction, this injection being carried out at a level situated between the levels of withdrawal of the said first and second LNG fractions. The levels of withdrawal of the first LNG fraction and of reinjection of the second LNG fraction into the denitrogenation column are preferably separated by at least two theoretical fractionation stages.

DETAILED DESCRIPTION OF THE INVENTION

In one embodiment of the process according to the invention the LNG feedstock to be denitrogenated is first of all subjected to the dynamic primary decompression and the dynamically decompressed LNG feedstock is then split into a majority stream, which is subjected to the indirect heat exchange with the LNG fraction(s) withdrawn from the denitrogenation column, and then to the static secondary decompression, and into a minority stream, which is cooled by indirect heat exchange with the gaseous fraction rich in methane and in nitrogen and removed at the top of the denitrogenation column, and which is then decompressed statically, and the cooled and statically decompressed majority and minority streams are combined to form the cooled LNG feedstock which is introduced into the denitrogenation column.

The gaseous fraction rich in methane and in nitrogen, which is removed at the top of the denitrogenation column, is freed from its negative calories by indirect heat exchange with hotter fluids and is then compressed to the appropriate pressure to form a fuel gas stream employed on the site including the denitrogenation plant, the said compression being generally carried out in a number of stages.

According to an advantageous embodiment, a fraction of the fuel gas stream is diverted, the said fraction is converted into a partially liquefied gas fraction which has a temperature lower than that of the cooled LNG feedstock introduced into the denitrogenation column and a pressure corresponding substantially to that prevailing at the top of the denitrogenation column, the operation being carried out by compression, indirect heat exchange with the gaseous fraction rich in methane and in nitrogen, which is removed at the top of the denitrogenation column, then static decompression, and the partially liquefied gas fraction thus produced is injected into the denitrogenation column, as a reflux fluid, at a level situated between the level of introduction of the cooled LNG feedstock and the level of removal of the gaseous fraction rich in methane and nitrogen. This operating method improves the fractionation in the denitrogenation column and reduces the quantity of methane passing into the gaseous fraction removed at the top of the denitrogenation column.

In an alternative form of the above embodiment, which makes it possible to produce a gas consisting almost exclusively of nitrogen from the liquefied gas fraction, intended to form the reflux fluid of the denitrogenation column and made up of the diverted fraction of the fuel gas stream, the liquefied gas fraction originating from the indirect heat exchange stage is split into a first flow and a second flow of liquefied gas, the first flow of liquefied gas is subjected to a static decompression to form a decompressed flow which has a pressure corresponding substantially to the pressure prevailing at the top of the denitrogenation column, the second flow of liquefied gas is subjected to a decompression followed by a fractionation, in a distillation column, so as to produce, at the top of this column, a gas stream consisting almost exclusively of nitrogen and so as to draw off, at the bottom of the said column, a liquid stream composed of methane and nitrogen, the said liquid stream is subjected to a static decompression to form a decompressed two-phase stream which has a pressure corresponding substantially to that of the decompressed flow and the decompressed flow and two-phase stream are combined to form the reflux fluid injected into the denitrogenation column. In this alternative form, the decompressed two-phase stream, before being recombined with the decompressed flow, advantageously goes through an indirect heat exchange with the contents of the distillation column at a level of this column which is situated between the level of removal of the gas stream consisting almost exclusively of nitrogen and the level of introduction of the second flow of liquefied gas.

According to the invention the work generated by the turbine carrying out the dynamic primary decompression of the LNG to be denitrogenated can be employed for performing a proportion of the multistage compression which is carried out on the gaseous fraction rich in methane and nitrogen and removed at the top of the denitrogenation column, after recovery of the negative calories contained in the said fraction, and leads to the production of the fuel gas stream. The work generated by the dynamic decompression turbine is preferably employed for performing the final stage of the said multistage compression.

The LNG feedstock to be denitrogenated can be further subjected to an intermediate decompression between the primary and secondary decompressions in order to separate from the said feedstock a gaseous phase rich in methane and in nitrogen and to inject the said gaseous phase, after recovery of its negative calories, into an intermediate stage of the multistage compression leading to the production of the fuel gas stream.

BRIEF DESCRIPTION OF THE DRAWINGS

Other characteristics and advantages will emerge better on reading the description given below of a number of embodiments of the process according to the invention referring to FIGS. 1 to 4 of the attached drawing diagrammatically showing plants for implementing the said embodiments.

In these various figures the same component always carries the same reference symbol.

Figure 1:
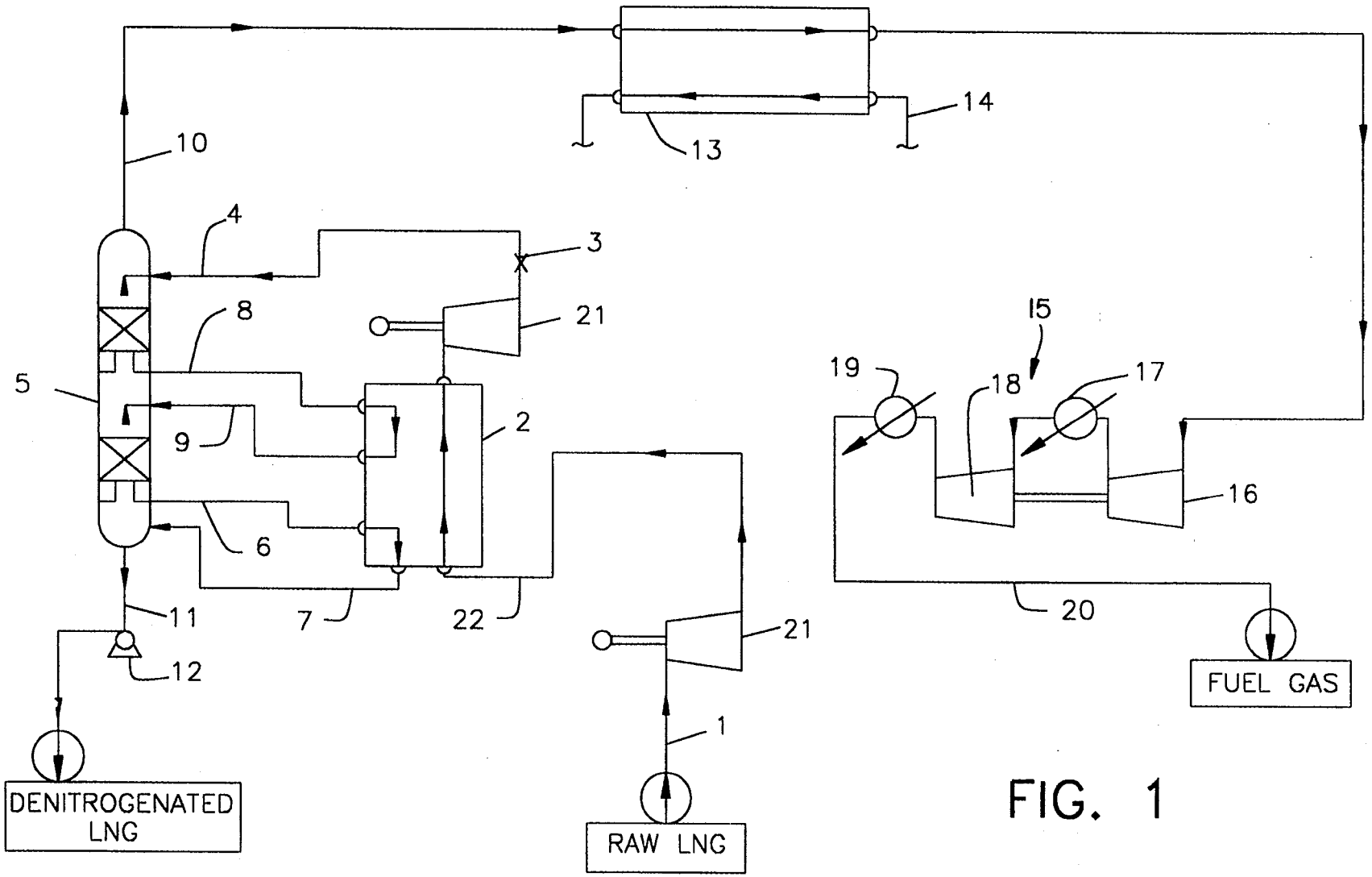
With reference to FIG. 1, a feedstock of an LNG to be denitrogenated, arriving via a conduit 1, undergoes a dynamic primary decompression in a turbine 21 to a pressure intermediate between the pressure of the LNG feedstock in the conduit 1 and the pressure of between 0.1 MPa and 0.3 MPa, the said intermediate pressure being preferably such that there is no vaporisation of LNG in the decompression turbine. This dynamic primary decompression provides a semidecompressed LNG stream 22 which then passes through the indirect heat exchanger 2 to be cooled therein, then undergoes a static secondary decompression while passing through the valve 3 to bring its pressure to a value of between 0.1 MPa and 0.3 MPa and to continue its cooling. The cooled and decompressed LNG feedstock is introduced, via a conduit 4, into a denitrogenation column 5, which consists of a fractionation column comprising a plurality of theoretical fractionation stages, the said column 5 being, for example, a plate column or a packed column. A first LNG fraction is withdrawn from the denitrogenation column 5 via a conduit 6 arranged at a level situated below the level of introduction of the cooled and decompressed LNG feedstock and the said fraction is subjected, in the heat exchanger 2, to an indirect countercurrentwise heat exchange with the LNG feedstock passing through the said exchanger, to cool this feedstock by means of the negative calories from the first LNG fraction, then, after the said heat exchange, this first fraction is reinjected into the column 5, via a conduit 7, as a first reboiling fraction, this injection being carried out at a level situated below the level of withdrawal of the first LNG fraction via the conduit 6. A second LNG fraction is also withdrawn, via a conduit 8, from the column 5, at a level situated between the level of introduction of the cooled and decompressed LNG feedstock and the level of withdrawal of the first LNG fraction, and the said second fraction is subjected, in the heat exchanger 2, to an indirect countercurrentwise heat exchange with the LNG feedstock which has already undergone the indirect heat exchange with the first LNG fraction to continue the cooling of the said feedstock, then, after the heat exchange, this second LNG fraction is reinjected into the column 5, via a conduit 9, as a second reboiling fraction, this injection being carried out at a level situated between the levels of withdrawal of the said first and second fractions. The levels of withdrawal of the first LNG fraction and of reinjection of the second LNG fraction into the denitrogenation column 5 are separated by at least two theoretical fractionation stages, that is to say by at least two trays in the case of a column 5 of the plate type or by at least a height of packing corresponding to two theoretical plates in the case of a column 5 of the packed type. A gaseous fraction rich in methane and in nitrogen and substantially at the temperature of the LNG feedstock introduced into the column 5 via the conduit 4 is removed at the top of the column 5, via a conduit 10, and a denitrogenated LNG stream suitable for storage or for transport is drawn off at the bottom of the column 5, via a conduit 11, in which a pump 12 is fitted. The gaseous fraction removed at the top of the column 5, via the conduit 10, is conveyed to undergo, in a heat exchanger 13, an indirect heat exchange with one or a number of fluids at higher temperature 14 so as to give up its negative calories thereto, and is then introduced, at the end of the heat exchange, into the first compressor 16 of a multistage compressor unit 15 comprising a first compressor 16 associated with a first cooler 17 and a second compressor 18 associated with a second cooler 19, the said compressor unit supplying a fuel gas stream 20 compressed to the pressure required for its use.

A fraction 28 of the fuel gas stream 20 is diverted and the said fraction is subjected to a treatment comprising a compression, in a compressor 29, then a cooling in a cooler 30 associated with the compressor 29, followed by a cooling by indirect countercurrentwise heat exchange in an indirect heat exchanger 31 placed between the indirect heat exchanger 13 and the compressor unit 15, and then in the said heat exchanger 13, with the gaseous fraction at low temperature and rich in methane and in nitrogen and discharged at the top of the denitrogenation column 5, via the conduit 10, and finally a static decompression through a valve 32, in order to produce a partially liquefied gas fraction which has a temperature lower than that of the cooled LNG feedstock introduced into the said column 5 and a pressure corresponding substantially to that prevailing at the top of this column, which partially liquefied gas fraction is injected into the column 5, via a conduit 33, as a reflux fluid at a level situated between the level of introduction of the cooled LNG feedstock via the conduit 4 and the level of removal, via the conduit 10, of the gaseous fraction at low temperature, rich in nitrogen and in methane.

Figure 2:
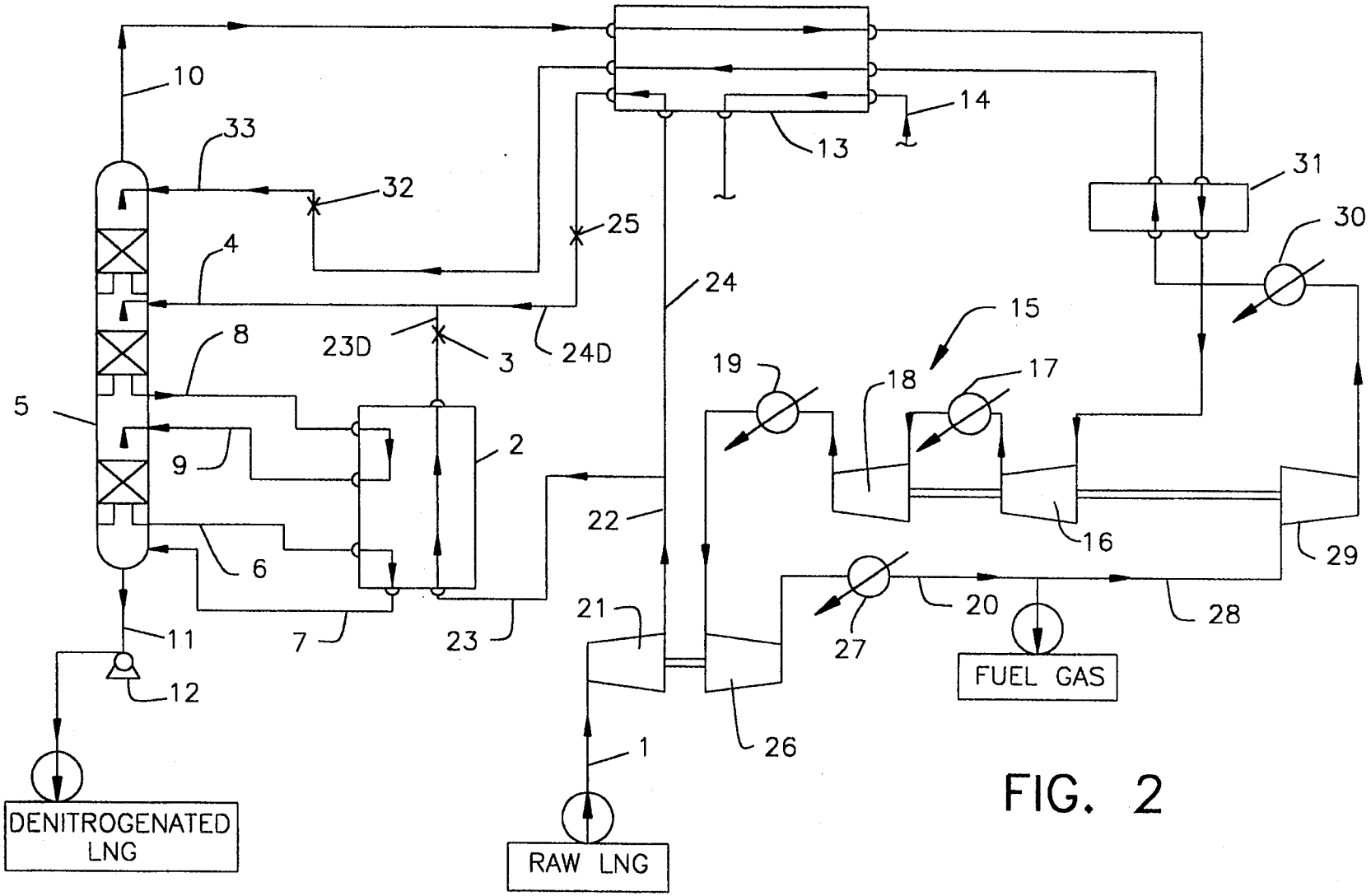
With reference to FIG. 2, which diagrammatically shows a plant containing all the components of the plant shown diagrammatically in FIG. 1, and other components, the LNG feedstock to be denitrogenated arriving via a conduit 1 undergoes a dynamic primary decompression in a turbine 21 to a pressure intermediate between the pressure of the LNG feedstock in the conduit 1 and the pressure of between 0.1 MPa and 0.3 MPa, the said intermediate pressure being preferably such that there is no vaporisation of LNG in the decompression turbine. This dynamic primary decompression provides a semidecompressed LNG stream 22, which is split into a majority stream 23, which is subjected to the indirect heat exchange in the indirect heat exchanger 2 in order to be cooled therein, then to the static secondary decompression by passing through the valve 3 in order to bring its pressure to the value of between 0.1 MPa and 0.3 MPa and to continue its cooling, and into a minority stream 24 which is conveyed to undergo, in the indirect heat exchanger 13, indirect countercurrentwise heat exchange with the gaseous fraction rich in methane and in nitrogen and removed at the top of the denitrogenation column 5, via the conduit 10, in order to lower its temperature and which is then statically decompressed, by passing through a valve 25, to bring its pressure to a value close to the said value of between 0.1 MPa and 0.3 MPa. The cooled and decompressed majority 23D and minority 24D LNG streams, originating from the valves 3 and 25 respectively, are combined to form the cooled and decompressed LNG feedstock which is introduced, via the conduit 4, into the denitrogenation column 5. The operations carried out in the denitrogenation column 5 and the indirect heat exchangers 2 and 13 include those described in the case of the corresponding components of the plant in FIG. 1. In addition to the compressors 16 and 18 and to the associated coolers 17 and 19, the compressor unit 15 comprises a final compressor 26 and an associated cooler 27, this latter compressor being driven by the decompression turbine 21. After having passed through the heat exchanger 13, the gaseous fraction 10 is conveyed to the compressor unit 15, in which the said fraction is compressed in three stages, firstly in the compressor 16, then in the compressor 18 and finally in the final compressor 26, to obtain at the exit of the compressor 26 a fuel gas stream 20 compressed to the pressure required for its use.
Figure 3:
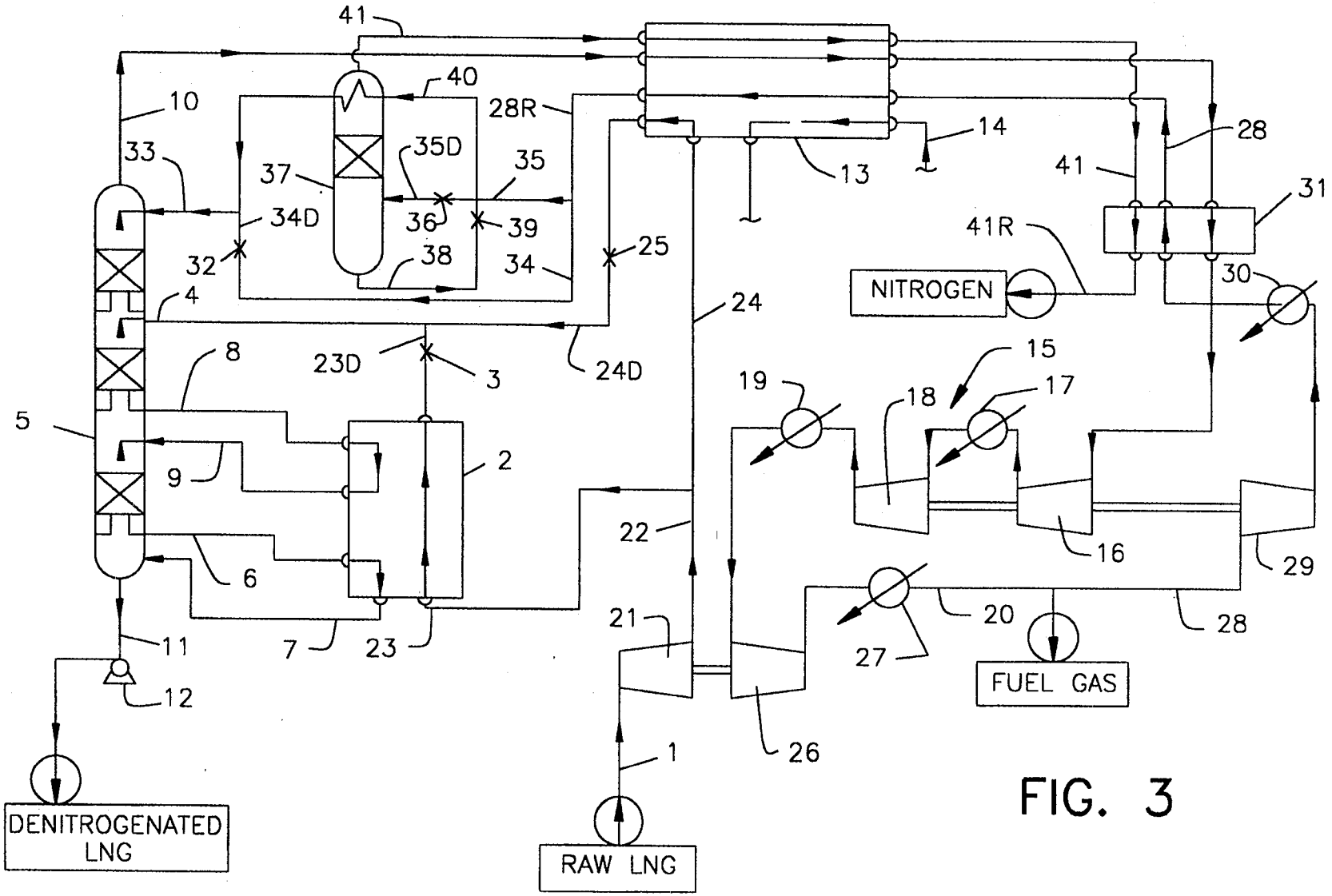

The embodiment of the process according to the invention which makes use of the plant diagrammatically shown in FIG. 3 differs from the embodiment of the process employing the plant diagrammatically shown in FIG. 2 only in an additional treatment of the liquefied gas fraction intended to form the reflux fluid of the denitrogenation column with a view to producing a reflux fluid depleted in nitrogen and a gas stream consisting almost exclusively of nitrogen. The plant in FIG. 3 therefore contains all the components of the plant in FIG. 2 and appropriate members for the said additional treatment. With reference to FIG. 3, the LNG feedstock to be denitrogenated, arriving via a conduit 1, is subjected to a treatment comparable with that described in the case of the embodiment employing the plant in FIG. 2. For the abovementioned additional treatment, the liquefied gas fraction 28R originating from the indirect heat exchange carried successively in the indirect heat exchangers 31 and 13 is split into a first flow 34 and a second flow 35 of liquefied gas. The first liquefied gas flow 34 is subjected to a static decompression by passing through the valve 32 to form a decompressed flow which has a pressure corresponding substantially to the pressure prevailing at the top of the denitrogenation column 5. The second liquefied gas flow 35 is subjected, after static decompression by passing through a valve 36, to a fractionation in a distillation column 37 so as to produce, at the top of this column, a gaseous stream 41 consisting almost exclusively of nitrogen and so as to draw off, at the bottom of the said column 37, a liquid stream 38 composed of methane and nitrogen. The liquid stream 38 is subjected to a static decompression by passing through a valve 39 in order to bring its pressure to a value corresponding substantially to that of the decompressed stream originating from the valve 32, then the decompressed two-phase stream 40 obtained passes through the upper part of the distillation column 37 in indirect heat exchange with the content of this column, at a level situated between the level of removal of the gaseous stream 41 and the level of introduction of the second liquefied gas flow 35, in order to cool further the said content, after which the said decompressed two-phase stream is combined with the decompressed flow originating from the valve 32 to form the partially liquefied gas fraction injected into the denitrogenation column 5, via the conduit 33, as reflux fluid. The gaseous stream 41 consisting almost exclusively of nitrogen and removed at the top of the distillation column 37 has a temperature which is between the temperature of the reflux fluid injected into the denitrogenation column 5 via the conduit 33 and the temperature of the cooled LNG feedstock introduced into the said column 5 via the conduit 4. This gaseous stream 41 is conveyed to pass successively through the indirect heat exchangers 13 and 31 in order to give up its negative calories to the hotter fluids, among others the fraction 28 diverted from the fuel gas 20 and the minority stream 24 of the semi-decompressed LNG feedstock, by indirect countercurrentwise heat exchange, before being directed towards its uses.

Figure 4:
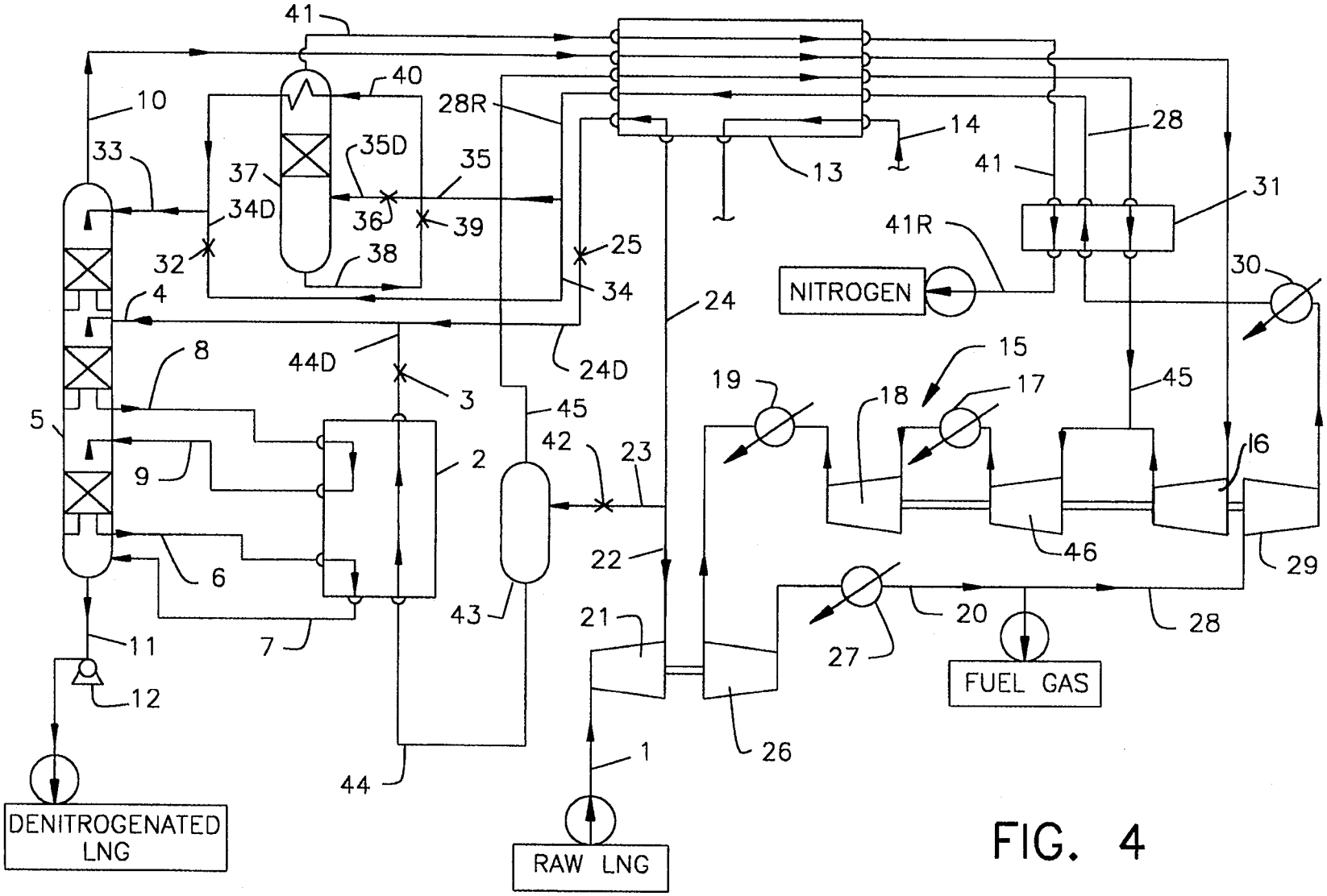

The embodiment of the process according to the invention which makes use of the plant diagrammatically shown in FIG. 4 differs from the embodiment of the process employing the plant diagrammatically shown in FIG. 3 only in the carrying out of an additional decompression of the majority stream 23 of the semidecompressed LNG feedstock before the stage of indirect heat exchange in the indirect heat exchanger 2, in order to separate from the said stream 23 a gaseous phase rich in methane and in nitrogen and to reduce the quantity of gaseous fraction 10 conveyed to the entry of the multi-stage compressor unit 15, the said gaseous phase being reinjected into the gaseous fraction 10 in an intermediate stage of the compression of this gaseous fraction in the compressor unit 15. With reference to FIG. 4, which contains all the components of FIG. 3 and other components, the LNG feedstock to be denitrogenated, arriving via a conduit 1, is subjected to a dynamic primary decompression in the turbine 21 to form the semidecompressed LNG stream 22, which is split into the minority stream 24, treated as shown in the embodiments which refer to FIGS. 2 and 3, and the majority stream 23. This semidecompressed LNG majority stream is subjected to an additional static decompression, to a pressure remaining higher than the pressure of between 0.1 MPa and 0.3 MPa downstream of the valve 3, by passing through a valve 42 and a separator bottle 43. A gaseous fraction 45 rich in methane and in nitrogen is removed at the top of the said separator 43 and an LNG stream 44 is drawn off at the bottom of this separator. This LNG stream 44 is next subjected to the treatment comprising the operations described in the case of the treatment of the majority LNG stream 23 in the embodiment of the process making use of the plant in FIG. 3 and resulting in the denitrogenated LNG stream 11, the fuel gas stream 20 and the nitrogen stream 41. The gaseous phase 45 rich in methane and in nitrogen is conveyed to pass successively through the indirect heat exchangers 13 and 31 in order to give up its negative calories to the hotter fluids, among others the fraction 28 diverted from the fuel gas stream 20 and the minority stream 24 of the semidecompressed LNG feedstock, by indirect countercurrentwise heat exchange, and it is then directed to the suction of a compressor 46, which is also fed by the compressor 16 of the multistage compressor unit 15 and the delivery of which is connected in series, through the cooler 17, to the suction of the compressor 18 of the compressor unit 15.

To supplement the preceding description, four examples of embodiments of the process according to the invention are given below, without any limitation being implied, each embodiment making use of a different plant chosen from those diagrammatically shown in FIGS. 1 to 4 of the attached drawing.

EXAMPLE 1

An LNG (liquefied natural gas) which had the following molar composition was treated by making use of a plant similar to that diagrammatically shown in FIG. 1 of the attached drawing and operating as described above:

| | |
|---|---|
| methane | 88% |
| ethane | 5.2% |
| propane | 1.7% |
| isobutane | 0.3% |
| n-butane | 0.4% |
| isopentane | 0.1% |
| nitrogen | 4.3% |

The LNG feedstock to be treated, arriving via the conduit 1 at a rate of 20,000 kmol/h, a pressure of 5.7 MPa and a temperature of −149.3° C., underwent a dynamic primary decompression, in the turbine 21 to produce a semidecompressed LNG stream 22 at a temperature of −150° C. and a pressure of 450 kPa. The semidecompressed LNG stream 22 underwent a first cooling to −162° C. by passing through the indirect heat exchanger 2, then underwent a secondary decompression through the valve 3 to form a cooled and decompressed LNG feedstock at a temperature of −166° C. and a pressure of 120 kPa, which feedstock was introduced onto the top tray of the denitrogenation column 5 comprising eleven trays numbered sequentially downwards. A first LNG fraction was withdrawn at the level of the tenth tray from the column 5, via the conduit 6, the said fraction having a temperature of −159.5° C. and a flow rate of 19,265 kmol/h, and the said fraction was then passed through the indirect heat exchanger 2 and this fraction was next returned into the column 5, via the conduit 7, as a first reboiling fraction at a level situated under the lower tray of the said column. A second LNG fraction was withdrawn from the column 5 at the level of the fourth tray, via the conduit 8, the said fraction having a temperature of −164° C. and a flow rate of 19,425 kmol/h,, then the said fraction was passed through the indirect heat exchanger 2 and this fraction was next returned into the column 5, via the conduit 9, as a second reboiling fraction at a level situated between the fourth and fifth trays. A denitrogenated LNG stream which had a temperature of −158.5° C. and a molar nitrogen content of 0.2 % was drawn off at the bottom of the column 5, via the conduit 11, at a flow rate of 18,290 kmol/h. A gaseous fraction at a temperature of −166° C. and a pressure of 120 kPa was removed at the top of the column 5, via the conduit 10, at a flow rate of 1713 kmol/h, the said fraction containing, as molar percentage, 48.1 % of nitrogen and 51.9 % of methane, the higher hydrocarbons representing less than 40 ppm on a molar basis. The gaseous fraction 10 passed through the heat exchanger 13 where its temperature was brought to −46° C. by indirect countercurrentwise heat exchange with a fluid brought to a temperature of −25° C., and then it was conveyed to the suction of the first compressor 16 of the compressor unit 15 to be compressed in the said unit. This multistage compressor unit supplied 1713 kmol/h of a compressed fuel gas stream 20 which, after cooling in the cooler 19, had a temperature of 40° C. and a pressure of 2.5 MPa.

EXAMPLE 2

An LNG which had the same composition, pressure and flow rate as the LNG of Example 1 was treated by using a plant similar to that diagrammatically shown in FIG. 2 of the attached drawing and operating as described above.

The LNG feedstock, arriving via the conduit 1 at a temperature of −148.2° C. underwent a dynamic primary decompression in the turbine 21 to supply a semidecompressed LNG stream 22 at a temperature of −149° C. and a pressure of 450 kPa. The stream 22 was split into a majority stream 23 and a minority stream 24 which had flow rates of 19,100 kmol/h and 900 kmol/h respectively. The majority stream 23 underwent a first cooling to −162° C. by passing through the heat exchanger 2, then underwent a secondary decompression through the valve 3 to provide a cooled and decompressed LNG majority stream 23D at a temperature of −166° C. and a pressure of 120 kPa. The minority stream 24 was cooled to −164° C. by passing through the indirect heat exchanger 13, then underwent a decompression through the valve 25 to produce a decompressed and cooled LNG minority stream 24D at a temperature of −167° C. and a pressure of 120 kPa. The cooled and decompressed LNG majority 23D and minority 24D streams were combined to form the LNG feedstock introduced, via the conduit 4, onto the top tray of the denitrogenation column 5 comprising eleven trays numbered sequentially downwards. The first and second LNG fractions were withdrawn from the column 5, were directed towards the indirect heat exchanger 2 and were then returned to the column 5 as reboiling fractions as indicated in Example 1. The first LNG fraction, passing through the conduit 6, was at a temperature of −159.5° C. and a flow rate of 19,600 kmol/h and the second LNG fraction, passing through the conduit 8, was at a temperature of −165° C. and a flow rate of 19,700 kmol/h. A denitrogenated LNG stream at a temperature of −158.5° C. and with a molar nitrogen content of 0.2% was drawn off at the bottom of column 5, via the conduit 11, at a flow rate of 18,520 kmol/h. A gaseous fraction at a temperature of −169° C. and a pressure of 120 kPa was removed at the top of the column 5, via the conduit 10, at a flow rate of 1976 kmol/h, the said fraction containing, as molar percentage, 55.8% of nitrogen and 44.2% of methane. The temperature of the gaseous fraction 10 was brought to −45° C. and then to −25° C. by passing successively through indirect heat exchangers 13 and 31, then the said gaseous fraction was conveyed to the suction of the first compressor 16 of the compressor unit 15 to be compressed in three stages, first of all in the compressors 16 then 18 and lastly in a final compressor 26, this last compressor being driven by the decompression turbine 21. At the delivery of the compressor 26, 1976 kmol/h of a compressed fuel gas stream 20 were obtained which, after cooling in the cooler 27, had a temperature of 40° C. and a pressure of 2.5 MPa. A fraction 28, representing 500 kmol/h was withdrawn from the compressed fuel gas stream 20. The said fraction was compressed to a pressure of 5.5 MPa in the compressor 29 and then cooled to −148° C. by passing successively through the cooler 30, the heat exchanger 31 and the heat exchanger 13, and was finally decompressed by passing through the valve 32, to produce a partially liquefied gas fraction at a temperature of −186° C. and a pressure of 120 kPa, which partially liquefied gas fraction was injected into the denitrogenation column 5, via the conduit 33, as a reflux fluid at a level of this column situated between the top tray and the departure level of the conduit 10.

EXAMPLE 3

An LNG which had the same composition, pressure and flow rate as the LNG of Example 1 was treated by using a plant similar to that diagrammatically shown in FIG. 3 of the attached drawing and operating as described above.

The LNG feedstock arriving via the conduit 1 at a temperature of −148.2° C. underwent a dynamic primary decompression in the turbine 21 to supply a semidecompressed LNG stream 22 at a temperature of −149° C. and a pressure of 450 kPa. The stream 22 was split into a majority stream 23 and a minority stream 24 which had flow rates of 19,100 kmol/h and 900 kmol/h respectively. The majority stream 23 underwent a first cooling to −162° C. by passing through the heat exchanger 2 and then underwent a secondary decompression through the valve 3 to provide a cooled and decompressed LNG majority stream 23D at a temperature of −166° C. and a pressure of 120 kPa. The minority stream 24 was cooled to −164° C. by passing through the heat exchanger 13, then underwent a decompression through the valve 25 to produce a decompressed and cooled LNG minority stream 24D at a temperature of −167° C. and a pressure of 120 kPa. The cooled and decompressed LNG majority 23D and minority 24D streams were combined to form the LNG feedstock introduced, via the conduit 4, onto the third tray of the denitrogenation column comprising eleven trays numbered sequentially downwards. The first and second LNG fractions were withdrawn from the column 5, were directed towards the indirect heat exchanger 2 and were then returned to the column 5 as reboiling fractions as indicated in Example 2. The first LNG fraction, passing through the conduit 6, was at a temperature of −159.5° C. and a flow rate of 19,610 kmol/h and the second LNG fraction, passing through the conduit 8, was at a temperature of −165° C. and a flow rate of 19,710 kmol/h. A partially liquefied gas fraction at a temperature of −184.5° C. and a pressure of 120 kPa was injected as a reflux fluid, via the conduit 33, at a level of the column 5 situated between the top tray and the departure level of the conduit 10. A denitrogenated LNG stream at a temperature of −158.5° C. and with a molar nitrogen content of 0.2% was drawn off at the bottom of the column 5, via the conduit 11, at a rate of 18,530 kmol/h.

A gaseous fraction at a temperature of −168° C. and a pressure of 120 kPa was removed at the top of the column 5, via the conduit 10, at a flow rate of 1875 kmol/h, the said fraction containing, as molar percentage, 52.9% of nitrogen and 47.1% of methane. The temperature of the gaseous fraction 10 was brought to −45° C. and then to −28° C. by passing successively through the indirect heat exchangers 13 and 31, then the said fraction was compressed in three stages as described in Example 2. At the delivery of the compressor 26, 1875 kmol/h of a compressed fuel gas stream 20 were obtained which, after cooling in the cooler 27, had a temperature of 40° C. and a pressure of 2.5 MPa. A fraction 28, representing 500 kmol/h, was withdrawn from the compressed fuel gas stream 20. The said fraction was compressed to a pressure of 5.5 MPa in the compressor 29 and then cooled by passing successively through the cooler 30, the heat exchanger 31 and the heat exchanger 13 to supply a liquefied gas fraction 28R at a temperature of −148° C. and a pressure of 5.4 MPa, which fraction 28R was split into a first flow 34 and a second flow 35 of liquefied gas, the said flows having flow rates of 1 kmol/h and 499 kmol/h respectively. The first liquefied gas flow 34 was subjected to a decompression through the valve 32 to form a decompressed flow 34D at a temperature of −185° C. and a pressure of 1.20 kPa. The second liquefied gas flow 35 was subjected to a decompression through the valve 36 to provide a decompressed second flow 35D at a temperature of −165° C. and a pressure of 710 kPa and the flow 35D was subjected to a fractionation in the distillation column 37 comprising eleven trays. 403 kmol/h of a liquid stream 38 consisting, as molar percentage, of 41.7% of nitrogen and 58.3% of methane were drawn off at the bottom of the column 37. The said stream 38 was subjected to a decompression through the valve 39 to form a decompressed two-phase stream 40 at a temperature of −185° C. and a pressure of 135 kPa, which stream 40 passed through the upper part of the distillation column 37 in indirect heat exchange with the content of this column, at a level situated between the top tray of the said column and the departure level of the conduit 41 at the top of the column, after which the said stream 40 was combined with the decompressed flow 34D to form the partially liquefied gas fraction injected as reflux fluid into the denitrogenation column 5. A gas stream 41 consisting, as molar percentage, of 99.9% of nitrogen and 0.1% of methane was removed at the top of the distillation column 37, the said stream having a flow rate of 96 kmol/h, a temperature of −174.5° C. and a pressure of 700 kPa. The gas stream 41 was passed successively through the indirect heat exchangers 13 and 31 to recover the negative calories which it contained and to produce a nitrogen stream 41R at a temperature of 30° C. and a pressure of 680 kPa.

EXAMPLE 4

An LNG which had the same composition, pressure and flow rate as the LNG of Example 1 and a temperature of −146° C. was treated by using a plant similar to that diagrammatically shown in FIG. 4 of the attached drawing and operating as described above.

The LNG feedstock arriving via the conduit 1 underwent a dynamic primary decompression in the turbine 21 to provide a semidecompressed LNG stream 22 at a temperature of −146° C. and a pressure of 500 kPa. The stream 22 was split into a majority stream 23 and a minority stream 24 which had flow rates of 19,100 kmol/h and 900 kmol/h respectively. The majority stream 23 was decompressed to a pressure of 387 kPa by passing through the valve 42 and separated in the separator bottle 43 into a gaseous fraction and an LNG fraction. A gaseous phase 45 consisting, as molar percentage, of 39.22% of nitrogen, of 60.76% of methane and of 0.02% of ethane and having a flow rate of 455 kmol/h, a temperature of −149° C. and a pressure of 387 kPa was removed at the top of the separator.

An LNG stream 44 at a temperature of −149° C. and a pressure of 390 kPa was drawn off at the bottom of the separator, at a flow rate of 18,645 kmol/h. The LNG stream 44 underwent cooling to −162° C. by passing through the heat exchanger 2, then underwent a secondary decompression through the valve 3 to produce a cooled and decompressed LNG majority stream 44D at a temperature of −165° C. and a pressure of 120 kPa. The minority stream 24 was cooled to −164° C. by passing through the heat exchanger 13, then underwent a decompression through the valve 25 to produce a decompressed and cooled LNG minority stream 24D at a temperature of −166° C. and a pressure of 120 kPa. The cooled and decompressed LNG majority 44D and minority 24D streams were combined to form the LNG feedstock introduced, via the conduit 4, onto the third tray of the denitrogenation column 5 comprising eleven trays numbered sequentially downwards. The first and second LNG fractions were withdrawn from the column 5, were directed towards the indirect heat exchanger 2 and were then returned to the column 5 as reboiling fractions as indicated in Example 3. The first LNG fraction, passing through the conduit 6, was at a temperature of −159.5° C. and a flow rate of 19,470 kmol/h and the second LNG fraction, passing through the conduit 8, was at a temperature of −164° C. and a flow rate of 19,660 kmol/h. A partially liquefied gas fraction at a temperature of −182° C., a flow rate of 740 kmol/h and a pressure of 120 kPa was injected, via the conduit 33, as reflux fluid at a level of the column 5 situated between the top tray and the departure level of the conduit 10. 18,520 kmol/h of a denitrogenated LNG stream at a temperature of −158.5° C. and with a molar nitrogen content of 0.2% was drawn off at the bottom of the column 5, via the conduit 11. A gas fraction at a temperature of −168° C. and a pressure of 120 kPa was removed at the top of the column 5, via the conduit 10, at a flow rate of 1760 kmol/h, the said fraction containing, as molar percentage, 52.1% of nitrogen and 47.9% of methane.

The temperature of the gaseous fraction 10 was brought to −40° C. by passing through the heat exchanger 13, then the said fraction was conveyed to the suction of the compressor 16 of the compressor unit 15 to be compressed in four stages, firstly in the successive compressors 16, 46 and 18 and lastly in the final compressor 26, this latter compressor being driven by the decompression turbine 21. The gaseous phase 45 removed at the top of the separator 43 passed successively through the heat exchangers 13 and 21 to recover the negative calories which it contained and was then conveyed, at a temperature of 38° C., to the suction of the compressor 46 which is also fed by the compressor 16. At the delivery of the compressor 26, 2215 kmol/h of a compressed fuel gas stream 20 were obtained which, after cooling in the cooler 27, had a temperature of 40° C. and a pressure of 2.5 MPa. A fraction 28, representing 925 kmol/h, was withdrawn from the compressed fuel gas stream 20. The said fraction was compressed to a pressure of 7 MPa in the compressor 29 and then cooled by passing successively through the cooler 30, the heat exchanger 31 and the heat exchanger 13, to provide a liquefied gas fraction 28R at a temperature of −146° C. and a pressure of 6.9 MPa, which fraction 28R was split into a first flow 34 and a second flow 35 of liquefied gas, the said flows having flow rates of 1 kmol/h and 924 kmol/h respectively. The first liquefied gas flow 34 was subjected to a decompression through the valve 32 to form a decompressed flow 34D at a temperature of −183° C. and a pressure of 120 kPa. The second liquefied gas flow 35 was subjected to a decompression through the valve 36 to provide a second decompressed flow 35D at a temperature of −163° C. and a pressure of 710 kPa and the flow 35D was subjected to a fractionation in the distillation column 37 comprising eleven trays. 740 kmol/h of a liquid stream 38 consisting, as molar percentage, of 36.9% of nitrogen and 63.2% of methane and containing less than 50 ppm of ethane on a molar basis were drawn off at the bottom of the column 37.

The said stream 38 was subjected to a decompression through the valve 39 to form a decompressed two-phase stream 40 at a temperature of −183° C. and a pressure of 135 kPa, which stream 40 passed through the upper part of the distillation column in indirect heat exchange with the content of this column as indicated in Example 3, after which the said stream 40 was combined with the decompressed flow 34D to form the partially liquefied gas fraction injected as reflux fluid into the denitrogenation column 5. A gas stream 41 consisting, as molar percentage, of 99.9% of nitrogen and of 0.1% of methane was removed at the top of the distillation column 37, the said stream having a flow rate of 184 kmol/h, a temperature of −174.5° C. and a pressure of 700 kPa. The gas stream 41 was passed successively through the indirect heat exchangers 13 and 31 to recover the negative calories which it contained and to produce a nitrogen stream 41R at a temperature of 36.5° C. and a pressure of 680 kPa.

We claim:

1. A process for denitrogenation of a feedstock of a liquified mixture of hydrocarbons (LNG), consisting essentially of methane and containing at least 2 mol % of nitrogen to lower the nitrogen content to less than 1 mol %, wherein the LNG feedstock to be treated, is introduced into the process at a pressure higher than 0.5 MPa. is cooled by indirect heat exchange (2) and decompression (21, 3) to a pressure of between 0.1 MPa and 0.3 MPa, the cooled LNG feedstock is introduced into denitrogenation column (5) comprising a plurality of theoretical fractionation stages, at least one first LNG fraction (6) is withdrawn from the denitrogenation column at a level below a level (4) of introduction of the cooled LNG feedstock and the first fraction is subjected to indirect heat exchange with the LNG feedstock then, after the heat exchange, the first fraction is reinjected into the denitrogenation column as a first reboiling fraction (7), the reinjection being carried out at a level below the level of withdrawal of the first fraction, a gaseous fraction (10) rich in methane and in nitrogen is removed at the top of the denitrogenation column and a denitrogenated LNG stream (11) is drawn off at the bottom of the column, the improvement which comprises decompressing the LNG feedstock to be treated in a primary decompression carried out dynamically in a turbine at a point in fluid communication with the indirect heat exchange (2) between the LNG feedstock and the LNG fraction(s) (6,8) withdrawn from the denitrogenation column, and performing a secondary decompression (3) statically after the indirect heat exchange and the dynamic decompression.

2. The process according to claim 1, wherein the dynamic primary decompression (21) of the LNG feedstock is carried out to a pressure at which there is no vaporisation of LNG in the decompression turbine.

3. The process according to claim 2 wherein the work generated by the decompression turbine (21) carrying out the dynamic primary decompression of the LNG feedstock to be treated, is employed for performing a part (26) of the compression (15), of the gaseous fraction

(10) rich in methane and in nitrogen removed at the top of the denitrogenation column, after recovery of the negative calories contained in the fraction, to provide the fuel gas stream (20).

4. The process according to claim 1, wherein a second LNG fraction (8) is withdrawn from the denitrogenation column at a level of the column which is between the level of introduction of the cooled LNG feedstock and the level of withdrawal of the first LNG fraction, this second LNG fraction is subjected to indirect heat exchange (2) with the LNG feedstock which has already undergone indirect heat exchange with the first LNG fraction and, after the heat exchange, the second LNG fraction is reinjected into the denitrogenation column as a second reboiling fraction (9), the injection of the second reboiling fraction being carried out at a level between the level of withdrawal of the said first and second LNG fractions.

5. The process according to claim 4, wherein the levels of withdrawal of the first LNG fraction (6) and of reinjection of the second LNG fraction (9) into the denitrogenation column (5) are separated by at least two theoretical fractionation stages.

6. The process according to claim 1 wherein the LNG feedstock (1) to be denitrogenated is first subjected to the dynamic primary decompression (21), then the dynamically decompressed LNG feedstock is split into a major stream and a minor stream, the major stream (23) is is passed in indirect heat exchange (2) with the LNG fraction(s) (6, 8) withdrawn from the denitrogenation column, then to the static secondary decompression (3), and the minor stream (24) is cooled by indirect heat exchange (13) with the gaseous fraction (10) rich in methane and in nitrogen from the top of the denitrogenation column and then statically decompressed (25), the cooled and decompressed major and minor streams (44D, 24D) are combined to form the cooled LNG feedstock (4) which is introduced into the denitrogenation column (5).

7. The process according to claim 1 wherein the gaseous fraction (10) rich in methane and in nitrogen, from the top of the denitrogenation column (5), is heated by indirect heat exchange (13) with hotter fluids (14, 28) and is then compressed (15) to a desired pressure to form a fuel gas stream (20).

8. The process according to claim 7 wherein the LNG feedstock is subjected to an intermediate decompression (42) between the primary and secondary decompressions to separate from the feedstock a gaseous phase (45) rich in methane and nitrogen, and, after recovery of its negative calories (13, 31), the gaseous phase (45) is injected into an intermediate state (46) of the compressor (15) to provide the fuel gas stream (20).

9. The process according to claim 7, wherein a fraction (28) of the fuel gas stream (20) is diverted, the diverted fraction is converted into a partially liquefied gas fraction (33) at a temperature lower than that of the cooled LNG feedstock (4) introduced into the denitrogenation column (5) and a pressure corresponding to that prevailing at the top of the denitrogenation column, the operation being carried out by compression (29), indirect heat exchange (13) with at least the gaseous fraction rich in methane and in nitrogen from the top of the denitrogenation column, then static decompression (32), to form a partially liquefied gas fraction (33) and injecting the partially liquefied gas fraction into the denitrogenation column, as a reflux fluid, between the level of introduction of the cooled LNG feedstock (4) and the level of removal of the gaseous fraction (10) rich in methane and in nitrogen.

10. The process according to claim 9, wherein the liquefied gas fraction (28R) originating from the stage of indirect heat exchange (13) is split into a first stream (34) and a second stream (35) of liquefied gas, the first liquefied gas stream (34) is subjected to a static depression (32) to form a decompressed stream (34D) at a pressure corresponding substantially to the pressure prevailing at the top of the denitrogenation column, the second liquefied gas stream (35) is subjected to a decompression followed by a fractionation in the distillation column (37), so as to produce, at the top of the distillation column, a gaseous stream (41) consisting essentially of nitrogen and to draw off, at the bottom of the distillation column, a liquid stream (38) comprising methane and nitrogen, the liquid stream is subjected to a static decompression (39) in order to form a decompressed two-phase stream (40) at a pressure substantially the same as the pressure of the decompressed stream, and the decompressed stream (34D) and the two-phase stream (40) are combined to form a reflux fluid (33) injected into the denitrogenation column.

11. The process according to claim 10, wherein the decompressed two-phase stream (40) before being combined with the decompressed stream (34D), passes in indirect heat exchange with a portion of the contents of the distillation column (37), at a level of the column which is located between the level of removal of the gaseous stream (41) consisting essentially of nitrogen and the level of introduction of the second stream (35).

12. A process according to claim 1 wherein the turbine is located at a point upstream of the indirect heat exchange (2) between the LNG feedstock and the LNG fraction(s) (6, 8) withdrawn from the denitrogenation column, and performing a secondary decompression (3) statically after the indirect heat exchange and the dynamic decompression.

13. A process according to claim 1 wherein the turbine is located at a point downstream of the indirect heat exchange (2) between the LNG feedstock and the LNG fraction(s) (6, 8) withdrawn from the denitrogenation column, and performing a secondary decompression (3) statically after the indirect heat exchange and the dynamic decompression.

* * * * *